US008154203B2

(12) United States Patent
Kamada et al.

(10) Patent No.: US 8,154,203 B2
(45) Date of Patent: Apr. 10, 2012

(54) PLASMA DISPLAY REAR PANEL AND ITS MANUFACTURING METHOD

(75) Inventors: Minori Kamada, Shiga (JP); Kenichi Kawabe, Shiga (JP)

(73) Assignee: Panasonic Corporation, Osaka (JP)

( * ) Notice: Subject to any disclaimer, the term of this patent is extended or adjusted under 35 U.S.C. 154(b) by 632 days.

(21) Appl. No.: 12/375,221

(22) PCT Filed: Jul. 30, 2007

(86) PCT No.: PCT/JP2007/064882

§ 371 (c)(1),
(2), (4) Date: Jan. 27, 2009

(87) PCT Pub. No.: WO2008/016003

PCT Pub. Date: Feb. 7, 2008

(65) Prior Publication Data

US 2011/0140600 A1 Jun. 16, 2011

(30) Foreign Application Priority Data

Jul. 31, 2006 (JP) ..... 2006-207792

(51) Int. Cl.

| | |
|---|---|
| ***H01J 9/00*** | (2006.01) |
| ***H01J 9/24*** | (2006.01) |
| ***H01J 9/26*** | (2006.01) |
| ***H01J 17/49*** | (2012.01) |

(52) U.S. Cl. ..... 313/582; 313/567; 313/581; 313/583; 313/584; 313/585; 313/586; 313/587; 445/1; 445/24; 445/25

(58) Field of Classification Search ..... None
See application file for complete search history.

(56) References Cited

U.S. PATENT DOCUMENTS

| | | | | |
|---|---|---|---|---|
| 6,482,062 | B1 * | 11/2002 | Yao et al. | 445/24 |
| 7,525,251 | B2 * | 4/2009 | Kim | 313/582 |
| 7,683,543 | B2 * | 3/2010 | Hwang | 313/582 |
| 8,013,528 | B2 * | 9/2011 | Otsu et al. | 313/582 |
| 2004/0075389 | A1 * | 4/2004 | Kim et al. | 313/587 |
| 2006/0113908 | A1 * | 6/2006 | Lee | 313/582 |
| 2009/0142703 | A1 * | 6/2009 | Uchida et al. | 430/311 |
| 2009/0218945 | A1 * | 9/2009 | Kamada et al. | 313/582 |

FOREIGN PATENT DOCUMENTS

| | | | |
|---|---|---|---|
| JP | 10-321148 | A | 12/1998 |
| JP | 2000-299061 | A | 10/2000 |
| JP | 2002-270101 | A | 9/2002 |
| JP | 2005-25950 | A | 1/2005 |
| JP | 2006-156342 | A | 6/2006 |

* cited by examiner

*Primary Examiner* — Natalie Walford
(74) *Attorney, Agent, or Firm* — Hamre, Schumann, Mueller & Larson, P.C.

(57) ABSTRACT

A plasma display member does not cause an erroneous discharge in a display region end portion and includes: a substrate (1); a substantially stripe-shaped address electrode (2) arranged on the substrate (1); a dielectric layer (3) covering the address electrode (2) and a grid-shaped partition arranged on the dielectric layer (3) and having main walls (4) substantially parallel to the address electrode (2) and auxiliary walls (5) intersecting the main partitions (4). The auxiliary wall (5) intersecting the main wall (4) located at the outermost position among the main walls (4) located at non-display regions (7) at the right and left of a display region (6) has a bottom width identical to the bottom width (L1) of the main wall (4) located at the outermost position among the main walls (4) located at the non-display regions (7) at the right and left of the display region (6) which is multiplied by 0.3 to 1.0.

4 Claims, 3 Drawing Sheets

PLASMA DISPLAY REAR PANEL AND ITS MANUFACTURING METHOD

RELATED APPLICATIONS

This is a §371 of International Application No. PCT/JP2007/064882, with an international filing date of Jul. 30, 2007 (WO 2008/016003 A1, published Feb. 7, 2008), which is based on Japanese Patent Application No. 2006-207792, filed Jul. 31, 2006.

TECHNICAL FIELD

This disclosure provides a rear panel for plasma display in which a lattice-like barrier rib is formed on a substrate, and relates especially to a rear panel for plasma display which hardly generates an erroneous discharge of plasma.

BACKGROUND

As a useful component for flat and large TVs, plasma display panels (hereafter, referred to as PDP) have received greater attention. In the PDP, for example, on a glass substrate of front panel to be a display surface, a plural of coupled sustain electrode is formed with a material such as silver, chromium, aluminum or nickel. Furthermore, to cover the sustain electrode, a dielectric layer comprising glass as main component is formed in a thickness of 20 to 50 μm, and to cover the dielectric layer, a MgO layer is formed. On the other hand, on a glass substrate of rear panel, a plurality of address electrodes are formed in stripe-like fashion, and an a dielectric layer comprising glass as main component is formed to cover the address electrodes. On the dielectric layer, barrier ribs arc formed to partition discharge cells, and phosphor layers are formed in discharge spaces formed by the barrier ribs and the dielectric layer. In a PDP capable of displaying in full color, the phosphor layers are constituted with phosphors capable of irradiating respective RGB colors. The front panel and the rear panel are sealed such that the sustain electrodes on the glass substrate of the front panel and the address electrodes on the rear panel orthogonally intersect with each other, to form a PDP by enclosing a rare gas constituted with such as helium, neon or xenon in the gap between those substrates. Since pixels is formed, at intersections of the scan electrodes and the address electrodes as centers, the PDP has a plurality of pixels and it becomes possible to display an image.

For displaying an image in a PDP, when a sparkover voltage or more is charged between the sustain electrode and the address electrode in a selected pixel in a state in which no light is emitted, cations or electrons, generated by ionization, move to the electrode of the opposite polarity in the discharge space since the pixel acts as a capacitive load and charge the inner wall of the MgO layer, and the charge of the inner wall remains as wall charge without attenuation due to a high resistivity of the MgO layer.

Next, a discharge-sustaining voltage is charged between the scan electrode and the sustain electrode. It is possible to discharge even at a voltage lower than the sparkover voltage where the wall charge is present. By the discharge, xenon gas in the discharge space is excited and UV ray of 147 nm is generated, and a display becomes luminous by exciting the phosphor by the UV ray.

A rear panel for PDP in which, to enhance brightness by enlarging the surface area of phosphor layer, a lattice-like barrier rib consisting of main barrier ribs and auxiliary barrier ribs is known (e.g., refer to JP-H10-321148 A).

Regarding formation of the above-mentioned lattice-like barrier rib, it is general to form a lattice-like barrier rib pattern by a method such as coating a glass paste containing a low-melting-point glass powder and an organic component on the substrate on which the address electrodes and the dielectric layer are provided and patterning by a sandblast or a photolithography method, or by carrying out pattern printing by the transfer molding method or a screen printing method, and then carrying out firing to remove the organic component to form a lattice-like barrier rib of which main component is the low-melting-point glass.

However, in the case where a lattice-like barrier rib is formed by firing the barrier rib pattern prepared with such a glass paste, there was a problem that, due to a shrinkage by the organic component being removed at the firing, among the main barrier ribs, intersection portions of the main barrier ribs and the auxiliary barrier ribs positioned' n the nondisplay areas of right and left of the display area, especially, at the outermost portion thereof becomes higher than the height of the main barrier ribs positioned in the display area. In such a case where the height of the intersections of the main barrier ribs and the auxiliary barrier ribs of the nondisplay area become higher than the barrier ribs of the display area, when the PDP is emitted by applying a voltage, a charge-through becomes easy to occur at an edge of the display area, and there was an erroneous discharge such as a turning off of a cell in the edge of the display area which should normally emit, or an emitting of a neighboring cell which normally should not emit.

It could therefore be helpful to provide a plasma display member which does not generate an erroneous discharge at the edge of the display area.

SUMMARY

We thus provide rear panels for plasma displays having, on a substrate, approximately stripe-like address electrodes, a dielectric layer covering the address electrodes, and a lattice-like barrier rib positioned on the dielectric layer and consisting of main barrier ribs which are nearly parallel to the address electrodes and auxiliary barrier ribs intersecting the main barrier ribs, which is a rear panel for plasma display in which a bottom width of auxiliary barrier rib intersecting the main barrier rib positioned at the outermost portion, among the main barrier ribs positioned in nondisplay areas of right and left of the display area, is 0.3 to 1.0 times of a bottom width of the main barrier rib positioned at the outermost portion, among the main barrier ribs positioned in the nondisplay areas of right and left of the display area.

In addition, the production method of a rear panel for plasma display is a production method of a rear panel of the above-mentioned plasma display in which barrier ribs are formed, by coating a photosensitive glass paste consisting of an inorganic component mainly comprising glass powder and an organic component containing a photosensitive organic component on a substrate provided with address electrodes or precursor thereof and a dielectric layer or precursor thereof, exposing by using a photomask for forming precursors of auxiliary barrier rib, and after coating the photosensitive glass paste further, exposing by using a photomask for forming precursors of main barrier rib and developing to form precursors of barrier rib consisting of precursors of main barrier rib and precursors of auxiliary barrier rib, and firing to form barrier ribs, which is a production method of a rear panel for plasma display characterized in that a bottom width of precursor of auxiliary barrier rib intersecting the precursor of main barrier rib positioned at the outermost portion, among the precursors of main barrier rib positioned in nondisplay areas of right and left of a display area, is made into 0.3 to 1.0 times of a bottom width of precursor of main barrier rib positioned at the outermost portion, among the precursors of main barrier rib positioned in the nondisplay areas of right and left of the display area.

The intersection portion of, among the main barrier ribs, a main barrier rib of the nondisplay areas of right and left of the display area, especially, which are provided at both edges thereof and an auxiliary barrier rib does not become higher than the height of the main barrier ribs positioned in the display area, and in particular, it is possible to prevent an erroneous discharge at peripheral portion of the display area.

EXPLANATION OF REFERENCES

Figure 1:
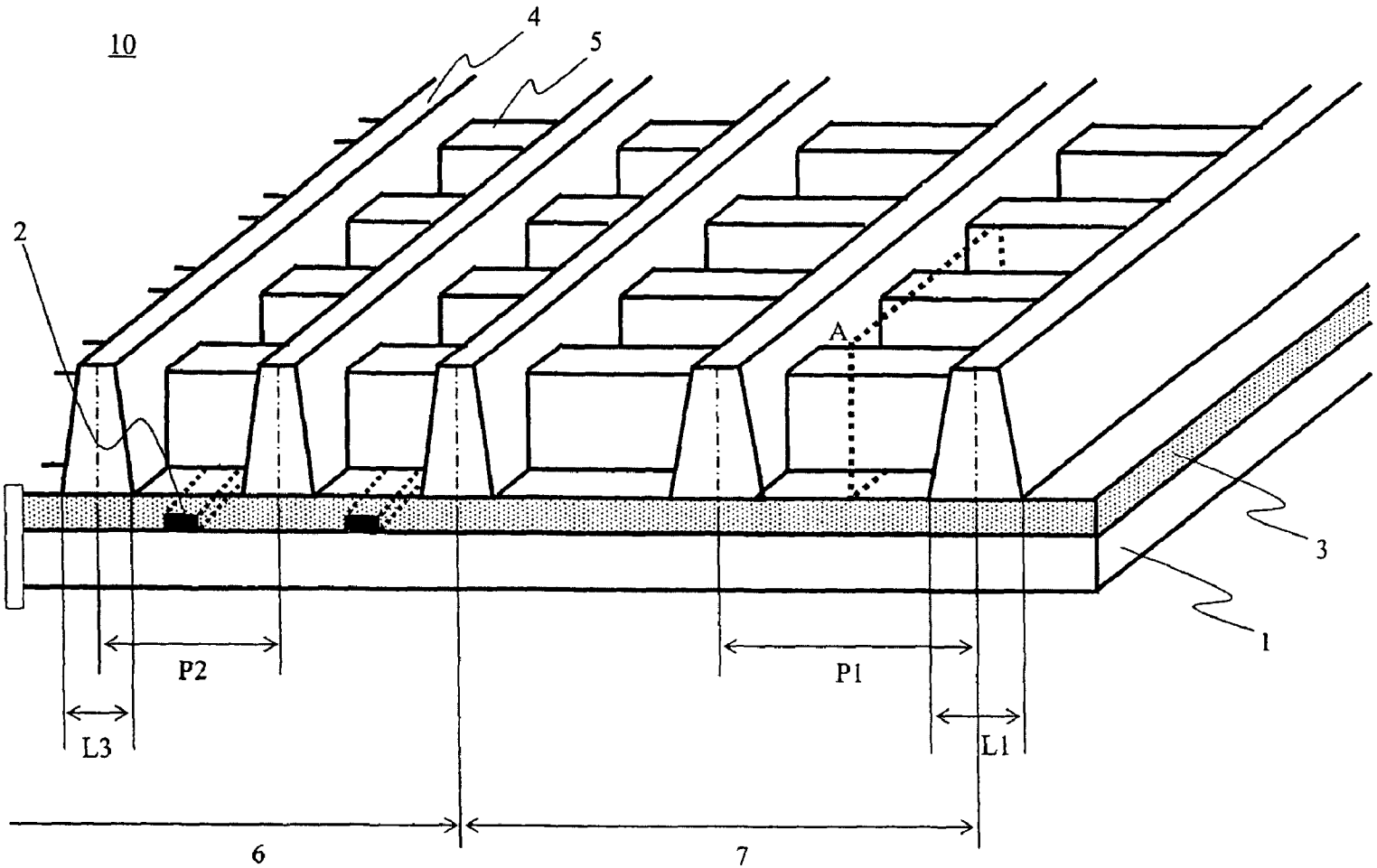
FIG. 1 is a schematic diagram showing a barrier rib shape of the rear panel for PDP from the longitudinal direction of the main barrier ribs.

1: substrate
2: address electrode
3: dielectric layer
4: main barrier rib
5: auxiliary barrier rib
6: display area
7: nondisplay area
8: edge of display area
9: outermost portion of nondisplay area
10: rear panel for PDP
11: outermost intersection portion of nondisplay area
P1: pitch between a main barrier rib positioned at the outermost portion of nondisplay area and a neighboring main barrier rib
P2: pitch between main barrier ribs positioned at display area
L1: bottom width of main barrier rib positioned at the outermost portion of nondisplay area
L2: bottom width of auxiliary barrier rib positioned at the outermost portion of nondisplay area
L3: bottom width of main barrier rib positioned at the outermost portion of display area
A: cut surface

DETAILED DESCRIPTION

Figure 2:
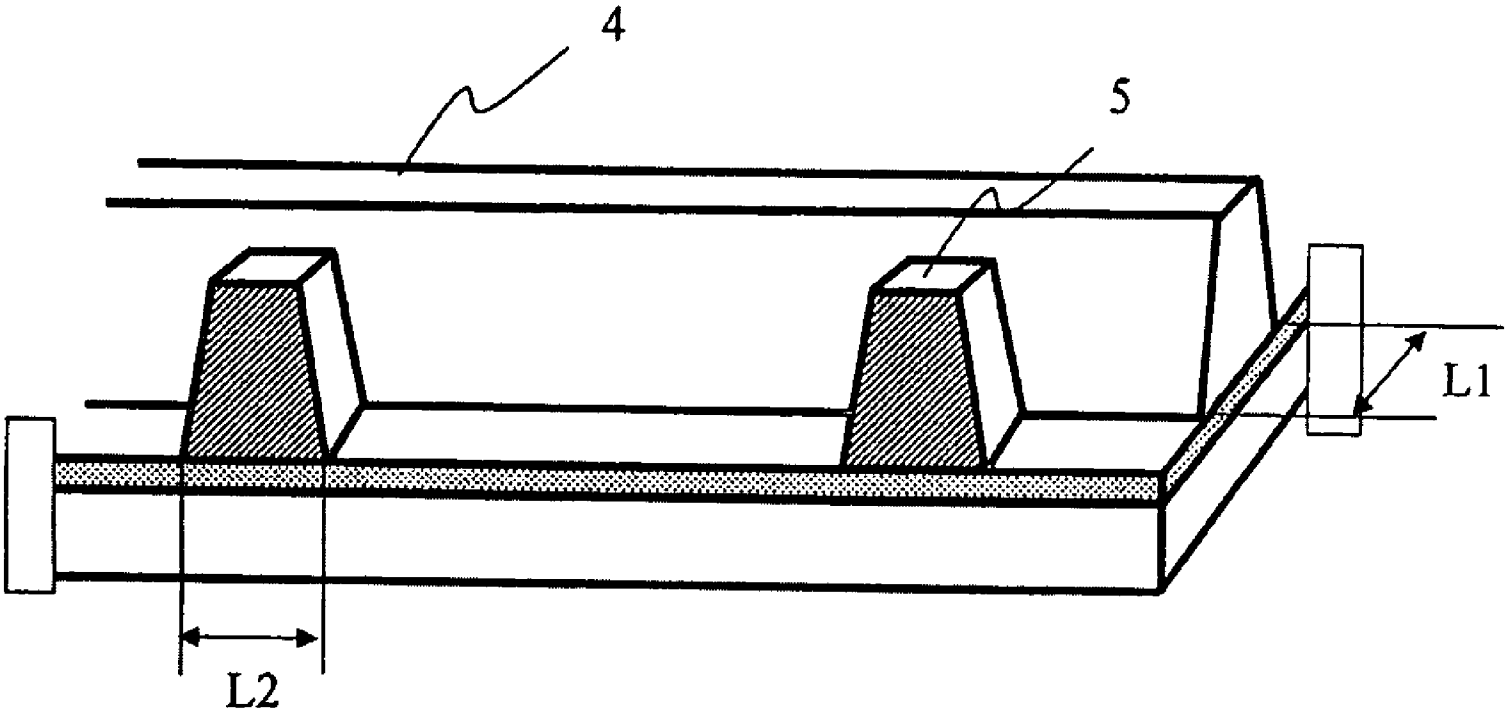
FIG. 2 is a schematic diagram showing a main barrier rib positioned at the outermost portion of the nondisplay areas of right and left of the display area of the rear panel for PDP, from the longitudinal direction of the auxiliary barrier ribs.
Figure 3:
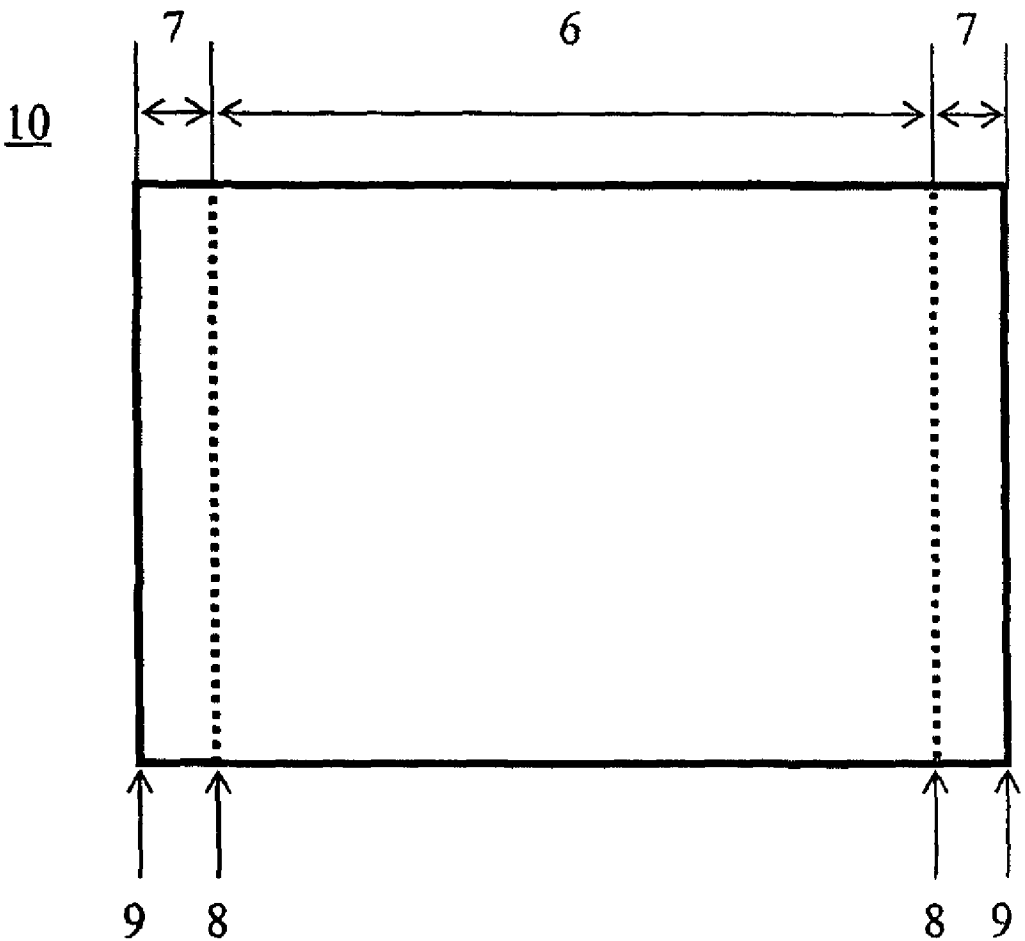
FIG. 3 is a schematic diagram showing the relation of positions on the rear panel for PDP.

Hereafter, our rear panels and methods are explained in detail with reference to the drawings. FIG. 1 is a schematic diagram showing a barrier rib shape of the rear panel for PDP from the longitudinal direction of the main barrier ribs. FIG. 2 is a schematic diagram showing a main barrier rib positioned at the outermost portion of the nondisplay areas of right and left of the display area of the rear panel for PDP, from the longitudinal direction of the auxiliary barrier ribs. FIG. 2 corresponds to a schematic diagram of the rear panel for PDP shown in FIG. 1, observed from the cut surface A. FIG. 3 is a schematic diagram showing the relation of positions on the rear panel for PDP.

As the substrate 1 used as the rear panel for PDP, soda glass, heat resistant glass for PDP or the like can be used, and concretely, PD200 produced by Asahi Glass Co., Ltd., PP8 produced by Nippon Electric Glass Co., Ltd. or the like can be mentioned.

The nearly stripe-like address electrode 2 is preferably formed on the substrate 1 with a metal such as silver, aluminum, chromium or nickel. As the forming method, a screen printing method in which a metal paste of which main components are these metal powder and an organic binder is printed or a photosensitive paste method in which, after coating a photosensitive metal paste in which a photosensitive organic component is used as an organic binder, it is subjected to a pattern exposure by using a photomask, unnecessary portions are dissolved and removed through a development process, and furthermore, heated and fired at 400 to 600° C. to form a metal pattern, can be employed. An etching method in which, after sputtering a metal such as chromium or aluminum on a glass substrate, a resist is coated, and after the resist is subjected to a pattern exposure and a development, the metal of unnecessary portion is removed, can be employed. As the electrode thickness, 1 to 10 μm is preferable, and 1.5 to 8 μm is more preferable. When the electrode thickness is too thin, disconnected patterns may become easy to occur, or resistance becomes high and an accurate driving may become difficult. On the other hand, when it is too thick, much amount of the material is necessary and it may become disadvantageous in cost. A width of the address electrode 2 is preferably. 20 to 200 μm, more preferably 30 to 150 μm. When the width of the address electrode 2 is too narrow, a defect such as disconnection and chip may become easy to occur and product yield decreases, or resistance becomes high and an accurate driving may become difficult. On the other hand, when it is too thick, it will be more likely that the reactive power will increase, and the distance between neighboring electrodes will decrease to cause short circuit. Furthermore, the address electrode 2 is formed in a pitch which depends on display cell (region which forms the respective RGB of pixel). It is preferable to form in a pitch of 100 to 500 μm for an ordinary PDP, and in a pitch of 50 to 400 μm for a high definition PDP. Nearly stripe-like means a stripe-like pattern having a nearly parallel pattern in line, or a pattern in which a part of the electrode of stripe-like pattern is thickened or a part is curved.

Successively, the dielectric layer 3 is formed. The dielectric layer 3 can be formed by, after coating a glass paste of which main components are a glass powder and an organic binder in a form which covers the address electrode 2, firing at 400 to 600° C. As the glass powder contained in the glass paste used for the dielectric layer 3, a glass powder containing at least one kind or more of lead oxide, bismuth oxide, zinc oxide and phosphorus oxide and containing 10 to 80 wt % of them in total can preferably be used. By making the compound into 10 wt % or more, it becomes easy to fire at 600° C. or less, and by making into 80 wt % or less to prevent crystallization, it becomes easy to fire at 600° C. or less.

It is possible to prepare a paste by kneading these glass powder and organic binder. As an organic binder to be used, cellulose-based compounds represented by ethyl cellulose, methyl cellulose or the like, acryl-based compounds such as methyl methacrylate, ethyl methacrylate, isobutyl methacrylate, methyl acrylate, ethyl acrylate or isobutyl acrylate, or the like can be used.

Furthermore, additives such as a solvent or a plasticizer may be added in the glass paste. As the solvent, widely-used solvents such as terpineol, butyrolactone, toluene, or methyl cellosolve can be used. As the plasticizer, dibutyl phthalate, diethyl phthalate, etc., can be used.

Furthermore, by adding filler other than the glass powder, it is possible to obtain a PDP having a high reflection and brightness. As the filler, titanium oxide, aluminum oxide and zirconium oxide or the like are preferable, and it is especially preferable to use a titanium oxide of which particle size is 0.05 to 3 μm. It is preferable that a content of the filler is, in the ratio of glass powder: filler, 1:1 to 10:1. By making the content of the filler into 1/10 or more to the glass powder, it is possible to achieve an actual effect, especially, improvement in brightness. By making into equal amount or less to the glass powder, it is possible to keep, especially, a high sintering performance. By adding an electroconductive fine particle, it is possible to manufacture a PDP which is highly reliable at driving. As the electroconductive fine particle, a metal powder such as of nickel or chromium is preferable, and as a particle size, 1 to 10 μm is preferable. By making it into 1 μm or more, a sufficient effect can be exhibited and by making it into 10 μm or less, it is possible to prevent unevenness on the dielectric layer to make formation of barrier rib easy. As a content of these electroconductive fine particles contained in the dielectric layer, 0.1 to 10 wt % is preferable. By making it into 0.1 wt % or more, an effective electroconductivity can be obtained, and by making it into 10 wt % or less, it is possible to sufficiently prevent a short circuit between neighboring address electrodes. A thickness of the dielectric layer 3 is preferably 3 to 30 μm and more preferably 3 to 15 μm. When the thickness of the dielectric layer 3 is too thin, a pinhole may occur frequently, and when it is too thick, discharge voltage becomes high and power consumption may become large.

Furthermore, in PDP, to control spreading of discharge into a predetermined region, to display in a prescribed cell, and to secure a uniform discharge space, a barrier rib (partitioning wall, also referred to as rib) is provided. As a shape of the barrier rib, in general, those such as of a stripe-like or a lattice-like, in a bottom width 20 to 120 μm and a height 50 to 250 μm, are mentioned.

Next, a method of forming the main barrier rib 4 and the auxiliary barrier rib 5 is explained. The main barrier rib 4 and the auxiliary barrier rib 5 are formed, after forming the address electrode 2 and the dielectric layer 3 on the substrate 1, by using a paste for barrier rib consisting of an insulating inorganic component and an organic component and by a publicly-known method such as screen printing method, sandblast method, photosensitive paste method (photolithography method), transfer molding method or lift off method, by forming a lattice-like precursor of barrier rib consisting of precursors of main barrier rib which are nearly parallel to the above-mentioned address electrode 2 and a precursors of auxiliary barrier rib which intersect the precursors of main barrier rib and by firing. For the reason of such as shape control and uniformity of the barrier rib, among them, so-called photosensitive paste method (photolithography method) in which a photosensitive paste is coated on a substrate and dried to form a photosensitive paste film and is subjected to an exposure through a photomask and development, is preferably applied.

To the intersection portion of a main barrier rib and an auxiliary barrier rib, a stress is concentrated at firing, and the intersection portion becomes lower by several μm than main barrier ribs in the vicinity. On the other hand, among the nondisplay area 7, at the intersection portions of main barrier rib and auxiliary barrier ribs positioned in the outermost portion 9 of the nondisplay area, a stress during firing is localized and the intersection portions becomes higher than main barrier ribs in the vicinity. This is caused because the intersection portions of the outermost portion are of T-shaped, the firing stress of the precursor of auxiliary barrier rib is loaded in one direction, namely, only in the direction of the display area side, and the intersection portions are raised high during firing. When the intersection portions of main barrier rib and auxiliary barrier ribs positioned at the outermost portion 9 of the nondisplay area become higher than the height of the main barrier ribs positioned in the display area, an erroneous discharge at the edge of the display area 8 occurs.

Thus, we provide a rear panel for PDP having a lattice-like barrier rib consisting of the main barrier ribs 4 and the auxiliary barrier ribs 5 which intersect main barrier ribs 4, characterized in that, a bottom width L2 of the auxiliary barrier ribs positioned at the outermost portion 9 of the nondisplay area among the auxiliary barrier ribs positioned in the nondisplay area 7 is 0.3 to 1.0 times of a bottom width L1 of the main barrier rib positioned at the outermost portion 9 of the nondisplay area among the main barrier ribs positioned in the nondisplay area 7. Here, the auxiliary barrier ribs positioned at the outermost portion 9 of the nondisplay area means the auxiliary barrier, ribs between a main barrier rib positioned at the outermost portion 9 of the nondisplay area and a neighboring main barrier rib.

Such main barrier ribs 4 and the auxiliary barrier ribs 5 can be formed, when the barrier ribs are formed by forming the precursor of lattice-like barrier rib consisting of the precursors of main barrier rib and the precursors of auxiliary barrier rib by using the paste for the barrier rib and by firing as mentioned above, by making the bottom width of the precursors of auxiliary barrier rib positioned at the outermost portion 9 of the nondisplay area among the precursors of auxiliary barrier rib positioned in the nondisplay area 7 into 0.3 to 1 times of the bottom width of the main barrier rib positioned at the outermost portion 9 of the nondisplay area among the precursors of main barrier rib positioned in the nondisplay area 7.

Furthermore, the production method of the rear panel for plasma display is a production method of a rear panel for plasma display formed by coating a photosensitive glass paste consisting of an inorganic component mainly comprising a glass powder and an organic component containing a photosensitive organic component on a substrate, by exposing it through a photomask for forming precursors of auxiliary barrier rib, and after the photosensitive glass paste is coated further, by exposing it through a photomask for forming precursors of main barrier rib, by developing and by firing, and it is possible to form a predetermined bottom width of the precursor of barrier rib by controlling a line width of the photomask for forming the precursor, an amount of exposure and a dried film thickness.

By making L2 into 0.3 to 1.0 times of L1 to make the firing stress to the display area of the auxiliary barrier rib positioned at the outermost portion small, it is possible to prevent becoming the height of the intersections of the outermost portion higher than the height of main barrier ribs of the display area. When L2 becomes larger than L1, the firing stress of the auxiliary barrier ribs increases, the height of intersection portions at the outermost portion becomes higher than the height of main barrier rib in the display area. On the other hand, when L2 is 0.3 times or less of L1, strength of the precursor of auxiliary barrier rib before firing decreases and adhesion with the dielectric layer at the time of development decreases, to cause problems such as peeling off of the auxiliary barrier rib at the time of firing.

Furthermore, it is preferable to make the bottom width L1 of the main barrier rib positioned at the outermost portion 9 of the nondisplay area into 1.2 to 3.0 times of the bottom width L3 of the main barrier rib in the display area 6. By making it into this range, it is possible to prevent that the height of the intersections with the auxiliary barrier ribs becomes higher than the height of the main barrier ribs positioned in the display area by increasing the firing stress to the longitudinal direction of the main barrier ribs positioned at the outermost portion 9 of the nondisplay area. It is possible to broaden a region capable of controlling the bottom width L2 of the auxiliary barrier ribs in the outermost portion. When L1 is smaller than 1.2 times of L3, it becomes necessary to form L2 finer than L1, and it becomes difficult to form the precursor of auxiliary barrier rib positioned at the outermost portion. In the case where L2 is larger than 3.0 times of L1, as well as the firing stress to the longitudinal direction of the main barrier rib, the firing stress to perpendicular direction of the stripe also increases, a warpage in top portion of the barrier rib generates, and the height of main barrier ribs in the nondisplay area 7 becomes higher than the height of the main barrier rib in the display area 6, and an erroneous discharge cannot be prevented.

Furthermore, to make easier to form the above-mentioned main barrier rib and auxiliary barrier ribs in the outermost portion of the nondisplay area, it is preferable that the pitch P2 between the main barrier rib positioned at the outermost portion 9 of the nondisplay area among the main barrier ribs positioned in the nondisplay area and the neighboring main barrier rib is at least 1.2 to 3 times of the pitch P1 of the main barrier ribs positioned in the display area. In the case where the pitch between the main barrier ribs positioned in the display area is not uniform, for example, in the case where the pitch is changed depending on kind (color) of phosphor, its average value is taken as the pitch between the main barrier ribs positioned in the display area.

Furthermore, as the above-mentioned, it is allowable if the pitch P2 between a precursor of main barrier rib positioned at the outermost portion and a neighboring precursor of main barrier rib is made into a pitch of at least 1.2 to 3.0 times of the pitch P1 between the main barrier ribs positioned in the display area, but to effectively prevent an erroneous discharge, it is preferable that the pitch between the main barrier ribs positioned in preferably 0.5 to 3 mm from the outermost portion of the nondisplay area, more preferably, the pitches of all the main barrier ribs positioned in the nondisplay area are made into pitches of 1.2 to 3.0 times of the pitch between the main barrier ribs positioned in the display area.

It is because by making P1 in the range of 1.2 to 3.0 times of P2, it becomes easy to form the bottom width L1 of the main barrier rib in the nondisplay area thicker by 1.2 to 3.0 times than the bottom width L3 of the main barrier rib in the display area. In the case where P1 is smaller than 1.2 times of P2, when L1 is tried to be formed thicker than L3, at forming the precursor of main barrier rib of the nondisplay area, neighboring bottoms of the barrier rib are connected, i.e., so-called a filling occurs. When a firing is carried out in a filled barrier rib, firing stress increases and problems occur such as a cracking of the dielectric layer. In the case where P1 is larger than 3.0 times of P2, since density of the main barrier rib in the nondisplay area 7 becomes low, and since support points for front panel when a front panel is put thereon significantly decreases, problems occur in strength such as a chip of top of the main barrier rib.

Manufacturing method of the barrier rib is not especially limited, but as above-mentioned, the photosensitive paste method is preferable since its steps are not many and forming a fine pattern is possible.

The photosensitive paste method is a method in which, by forming a coating film with a photosensitive glass paste consisting of an inorganic component mainly comprising a glass powder and an organic component containing a photosensitive organic component, subjecting it to an exposure through a photomask and a development to form a precursor of barrier rib, and then the precursor of barrier rib is subjected to a firing to obtain a barrier rib.

Hereafter, a forming method of the barrier rib by the photosensitive paste method which is preferably employed is explained, but is not limited thereto.

In the case where the barrier rib is formed by the photosensitive paste method, a photosensitive glass paste for the barrier rib is coated on a dielectric layer. The photosensitive paste is constituted with an inorganic component mainly comprising glass powder and an organic component containing a photosensitive organic component.

The photosensitive glass paste for the barrier rib is prepared by kneading by a roll mill or the like, after mixing these inorganic components and the organic component in a predetermined weight ratio.

Next, this photosensitive glass paste for the barrier rib is coated by a die coater and dried. After the drying, a photomask provided with a stripe-like pattern corresponding to a pattern of auxiliary barrier rib is prepared and an exposure operation is carried out by keeping positions of the substrate and the photomask by using an exposure device while maintaining a distance. (gap) between the photomask and the coating film on the substrate.

Then, the photosensitive glass paste for the barrier rib is coated by using a die coater again and dried.

After that, a photomask provided with two kinds of stripe-like pattern different in the display area and the nondisplay area which corresponds to the pattern of main barrier rib is prepared, and by using an exposure equipment, while securing, the distance (gap) between the coating film on the substrate, and fixing positions of the substrate and the photomask, an exposure operation is carried out. After the exposure, a precursor of barrier rib consisting of the precursor of main barrier rib and the precursor of auxiliary barrier rib are formed by a development, and furthermore, by a firing, a predetermined barrier rib is obtained.

The rear panel for plasma display can preferably be manufactured by making, after a development, a bottom width of the precursors of auxiliary barrier rib intersecting the precursor of main barrier rib positioned at the outermost portion among the precursors of main barrier rib positioned in the nondisplay areas of right and left of the display area, 0.3 to 1.0 times of a bottom width of the precursor of main barrier rib positioned at the outermost portion among the precursors of main barrier rib positioned in the nondisplay areas of right and left of the display area, and then firing.

The pitch of barrier rib means, as shown in FIG. 1, the interval from a center portion of barrier rib to a center portion of the next barrier rib, and the bottom widths of barrier rib mean, as shown in FIG. 1, bottom widths of the respective barrier ribs. The shape of the barrier rib may be a rectangle or a trapezoid. A height the auxiliary barrier rib is lower than a height of the main barrier rib, and it is preferable to be a height of ½ to 11/12 of the height of main barrier rib.

Methods for measuring the pitch between main barrier ribs, the bottom width, the height of barrier rib and the height of intersection are not especially limited, but it is preferable to measure by using an optical microscope, a scanning electron microscope, or a laser scanning microscope.

For example, in the case where a scanning electron microscope (HITACHI S-2400) is used, the following method is preferable. For an accurate measurement of the edge of the barrier rib, a sample is cut such that a cross-section is perpendicular to the main barrier rib, and processed into a size capable of an observation. A magnification for measurement is selected in a range capable of viewing an inclined portion. A photograph is taken after correcting a scale with a standard sample of the same size as the inclined portion. From the scale, a bottom width, a pitch, and a height are calculated.

Furthermore, in the case where a nondestructive measurement is desired, a laser focus displacement meter (for example, LT-8010 produced by Keyence Corp.) may be used. In this case, too, it is preferable to measure after correcting with a standard sample in the same way. At this time, to carry out an accurate measurement, it is preferable to confirm that the measuring surface of the laser is parallel to the stripe direction of the barrier rib.

Furthermore, the height of main barrier rib, the height of the intersection may be determined by an ultradeep microscope (produced by Keyence). Bottom width of the barrier rib and groove width of the barrier rib may be measured by a microscope (produced by Hyrox).

It is preferable that an amount of the inorganic component used for the photosensitive glass paste for the barrier rib is 40 to 85 wt % with respect to the sum of the inorganic component and the organic component.

If it is less than 40 wt %, shrinkage at the firing increases and it is not preferable since a disconnection or peeling off of the barrier rib becomes easy to occur. It becomes hard to be dried paste to cause stickiness and printing properties may be impaired. Furthermore, widening of pattern and a generation of residual film at development may occur. If it is larger than 85 wt %, since the photosensitive organic component is not sufficient, light curing does not react at the bottom of barrier rib pattern, and the pattern-forming performance may be impaired.

In the case where this method is employed, it is preferable to use the following glass powder as the inorganic component.

To the glass powder, by adding such as aluminum oxide, barium oxide, calcium oxide, magnesium oxide, zinc oxide, zirconium oxide, especially, by adding aluminum oxide, barium oxide or zinc oxide, it is possible to control softening point, thermal expansion coefficient and refractive index, but as to its content, 40 wt % or less is preferable, and more preferably 25 wt % or less.

Furthermore, a glass generally used as an insulator has a refractive index of about 1.5 to 1.9, but in the case where a photosensitive paste meted is employed, and in the case where an average refractive index of organic component is largely different from an average refractive index of the glass powder, in the interface between the glass powder and the organic component, reflection or scattering increases and a precise pattern cannot be obtained. Since refractive index of generally-used organic component is 1.45 to 1.7, to match refractive indexes of the glass powder and the organic component, it is preferable to make an average refractive index of the glass powder into 1.5 to 1.7. Furthermore, it is more preferable to make it into 1.5 to 1.65.

By using a glass containing 2 to 10 wt % in total of an alkali metal oxide such as sodium oxide, lithium oxide or potassium oxide, not only it becomes easy to control softening point and thermal expansion coefficient, but also since it is possible to lower average refractive index of glass, it becomes easy to decrease the difference of refractive index with the organic substance. When it is smaller than 2%, it becomes difficult to control the softening point. When it is larger than 10%, due to an evaporation of the alkali metal oxide at discharge, there may be a case in which brightness decreases. Furthermore, to improve stability of the paste, too, it is preferable that the amount of alkali metal oxide to be added is less than 8 wt %, more preferably 6 wt % or less.

In particular, among the alkali metals, it is preferable to use lithium oxide, since it is possible to relatively increase stability of the paste. In the case where potassium oxide is used, there is a merit that, even by an addition of a relatively small amount, refractive index can be controlled.

This results in having a softening point capable of being fired on a glass substrate, makes it possible that an average refractive index is 1.5 to 1.7 and makes it easy that a refractive index difference from the organic component is small.

A particle size of the glass powder used in the above-mentioned is selected in consideration of a line width or a height of barrier rib to be prepared, but it is preferable that particle size of 50 vol % (average particle size, D50) is 1 to 6 μm, maximum particle size is 30 μm or less and specific surface area is 1.5 to 4 $m^2/g$. More preferably, it is preferable that particle size of 10 vol % (D10) is 0.4 to 2 μm, particle size of 50 vol % (D50) is 1.5 to 6 μm, particle size of 90 vol % (D90) is 4 to 15 μm, maximum particle size is 25 μm or less and specific surface area is 1.5 to 3.5 $m^2/g$. Further preferably, D50 is 2 to 3.5 μm and specific surface area is 1.5 to 3 $m^2/g$.

D10, D50 and D90 can be obtained, respectively, from a distribution curve of volumetric-basis particle size, and from small particle, the mean particle sizes corresponding to 10 vol %, 50 vol % and 90 vol %.

When it is smaller than the above-mentioned particle size, since specific surface area increases, powder becomes easy to cohere and dispersibility in the organic component lowers, and air bubbles become easy to be included. Accordingly, light scattering increases and a widening of center of the barrier rib and an insufficiency of curing of the bottom occurs, and a preferable shape cannot be obtained. When it is large, property of filling is impaired due to a decrease of bulk density of the powder, and an amount of the photosensitive component becomes insufficient and air bubbles become easy to be included, to easily cause a light scattering, too.

Accordingly, there is an optimal range in the particle size distribution, and by using a glass powder in such a range of particle size distribution, property of filling with the powder is improved, air bubbles become hard to be included even when powder ratio of the photosensitive glass paste for the barrier rib is increased, and since unnecessary light scattering is small, the barrier rib pattern formation is maintained. In addition, since the filling rate of the powder is high, firing shrinkage decreases, pattern accuracy is improved, and a preferable barrier rib shape can be obtained.

As a filler, a high-melting-point glass powder containing 15 wt % or more of ceramics such as titania, alumina, barium titanate or zirconia, silicon oxide, or aluminum oxide, is preferable.

As a particle size of the filler to be used, an average particle size of 1 to 6 μm is preferable. It is preferable to use those having a particle size distribution, of which D10 (particle size of 10 vol %) is 0.4 to 2 μm, D50 (particle size of 50 vol %) is 1 to 3 μm, D90 (particle size of 90 vol %) is 3 to 8 μm, and a maximum particle size is 10 μm or less, for carrying out the pattern formation.

Still more preferably, it is preferable that D90 is 3 to 5 μm and the maximum particle size is 5 μm or less. It is preferable to be a fine powder of which D90 is 3 to 5 μm, since it is excellent in that a firing shrinkage can be made low, and in addition, a barrier rib of which void ratio is low is made. It becomes possible to make unevenness in longitudinal direction of upper portion of barrier rib into ±2 μm or less. When a powder with a large particle size is used as the filler, it is not preferable since, not only the void ratio increases, but also the unevenness of upper portion of barrier rib increases and causes an erroneous discharge.

As the organic component to be contained in the photosensitive glass paste for the barrier rib, it is possible to use cellulose compounds represented by ethyl cellulose, acryl polymers represented by polyisobutyl methacrylate or the like. Polyvinyl alcohol, polyvinyl butyral, polymer of methacrylic acid ester, polymer of acrylic acid ester, copolymer of acrylic acid ester and methacrylic acid ester, polymer of α-methyl styrene, butyl methacrylate resin, etc., are mentioned.

Other than those, to the glass paste, if necessary, various additives can be added, and in the case where a viscosity control is desired, an organic solvent may also be added. As the organic solvent to be used here, methyl cellosolve, ethyl cellosolve, butyl cellosolve, methyl ethyl ketone, dioxane, acetone, cyclohexanone, cyclopentanone, isobutyl alcohol, isopropyl alcohol, tetrahydrofuran, dimethyl sulfoxide, γ-butyrolactone, bromobenzene, chlorobenzene, dibromobenzene, dichlorobenzene, bromobenzoic acid, chlorobenzoic acid, terpineol, etc., and organic solvent mixtures containing one kind or more of these, are used.

The organic component contains at least one kind photosensitive organic component selected from a photosensitive monomer, a photosensitive oligomer and a photosensitive polymer, and furthermore, as required, an addition of additive components such as a binder, a photo-polymerization initiator, a UV absorber, a sensitizer, a sensitizing auxiliary, a polymerization inhibitor, a plasticizer, a thickening agent, an organic solvent, an antioxidant, dispersant, or an organic or inorganic suspending agent, is also carried out.

As the photosensitive organic component, there are those of photo-insolubilized type and photo-solubilized type, and as those of photo-insolubilized type, (A) those containing a functional monomer, oligomer or polymer having one or more unsaturated group or the like in the molecule, (B) those containing a photosensitive compound such as an aromatic diazo compound, an aromatic azide compound or an organic halogen compound, and (C) so-called diazo resins such as condensate of a diazo-based amine and formaldehyde, etc., are mentioned.

Furthermore, as the photo-solubilized type, (D) those containing a complex of an inorganic salt of a diazo compound and organic acid, or quinone diazos, (E) quinone diazos bonded with an appropriate polymer binder, for example, naphtoquinone-1,2-diazide-5-sulfonate of a phenol or novolac resin, etc., are mentioned.

As the photosensitive organic component used for the photosensitive glass paste for the barrier rib, it is possible to use all of the above-mentioned. As a photosensitive organic component which can conveniently be used as the photosensitive glass paste for the barrier rib by mixing with the inorganic component, those of (A) are preferable.

The photosensitive monomer is a compound containing a carbon-carbon unsaturated bond, and as its concrete examples, methyl acrylate, ethyl acrylate, n-propyl acrylate, isopropyl acrylate, n-butyl acrylate, sec-butyl acrylate, sec-butyl acrylate, isobutyl acrylate, tert-butyl acrylate, n-pentyl acrylate, allyl acrylate, etc., are mentioned. It is possible to use one kind, or two kinds or more of these.

Other than these, it is possible to improve performance of development after exposure by adding an unsaturated acid such as an unsaturated carboxylic acid. As concrete examples of the unsaturated carboxylic acid, acrylic acid, methacrylic acid, itaconic acid, crotonic acid, maleic acid, fumaric acid, vinyl acetic acid, or acid anhydride thereof, etc., are mentioned.

It is preferable that a content of these monomers is 5 to 30 wt % with respect to the sum of the inorganic component and the photosensitive organic component. In a range other than that, it is not preferable since an aggravation of pattern formation or an insufficiency of hardness after curing arises.

As the binder resin, polyvinyl alcohol, polyvinyl butyral, polymer of methacrylic acid ester, polymer of acrylic acid ester, copolymer of acrylic acid ester and methacrylic acid ester copolymer, polymer of α-methyl styrene, butyl methacrylate resin, etc., are mentioned.

Furthermore, it is possible to use an oligomer or polymer obtained by polymerizing at least one kind of compound having the above-mentioned carbon-carbon double bond. At the polymerization, it is possible to copolymerize with other photosensitive monomer such that a content of these photoreactive monomers would be 10 wt % or more, still more preferably 35 wt % or more.

As monomers to be copolymerized, by copolymerizing an unsaturated acid such as an unsaturated carboxylic acid, it is possible to improve performance of developing after exposure. As concrete examples of the unsaturated carboxylic acid, acrylic acid, methacrylic acid, itaconic acid, crotonic acid, maleic acid, fumaric acid, vinyl acetic acid, or an acid anhydride thereof, etc., are mentioned.

It is preferable that an acid value (AV) of the polymer or oligomer, thus obtained, having an acidic group such as carboxylic group in its side chain, is in the range of 30 to 150, furthermore, of 70 to 120. When the acid value is less than 30, solubility to developer of an unexposed portion decreases, and when concentration of the developer is increased, a peeling off up to exposed portion occurs, and a highly precise pattern is hard to be obtained. When the acid value exceeds 150, a tolerance of development is narrowed.

In the case where performance of development is imparted by a monomer such as an unsaturated acid, it is preferable since, a gelatification by a reaction between the glass powder and the polymer can be prevented, to make an acid value of the polymer into 50 or less.

By adding a photoreactive group to a side chain or molecular end of the above-mentioned polymer or oligomer, it is possible to use it as a photosensitive polymer or a photosensitive oligomer having photosensitivity. A preferable photoreactive group is that having an ethylenic unsaturated group. As the ethylenic unsaturated group, vinyl group, allyl group, acryl group, methacryl group or the like are mentioned.

As an amount of the polymer component containing of the photosensitive polymer, the photosensitive oligomer and the binder in the photosensitive glass paste, 5 to 30 wt % with respect to the sum of the glass powder and the photosensitive organic component is preferable since it is excellent in properties of pattern formation and shrinkage after firing. Out of this range, it is not preferable since a pattern formation is impossible or a widening of pattern occurs.

As concrete examples of the photopolymerization initiator, benzophenone, o-benzoyl methyl benzoate, 4,4-bis(dimethyl amine) benzophenone, 4,4-bis(diethyl amino) benzophenone, 4,4-dichlorobenzophenone, 4-benzoyl-4-methyl diphenyl ketone, dibenzyl ketone, fluorenone, 2,2-diethoxyacetophenone, 2,2-dimethoxy-2-phenyl-2-phenyl acetophenone, 2-hydroxy-2-methyl propiophenone, p-t-butyl dichloroacetophenone, thioxanthone, 2-methyl thioxanthone, 2-chlorothioxanthone, 2-isopropyl thioxanthone or combination of a photo-reductive pigment such as diethyl thioxanthone and a reducing agent such as ascorbic acid or triethanol amine, are mentioned. It is possible to use one kind, or two kinds or more of these.

The photopolymerization initiator is added in the range of 0.05 to 20 wt %, more preferably, 0.1 to 15 wt % with respect to the photosensitive organic component. When the amount of the polymerization initiator is too small, photosensitivity becomes poor, and when the amount of the photopolymerization initiator is too large, residual ratio of exposed portion may become too small.

It is also effective to add a UV absorber. By adding a compound having a high UV absorption feature, a high aspect ratio, a high definition and a high resolution are achieved. As UV absorbers, those composed of an organic dye, and among them, an organic dye having a high absorbing coefficient in the wavelength range of 350 to 450 nm is preferably used. Concretely, an azo-based dye, an aminoketone-based dye, a xanthene-based dye, a quinoline-based dye, an anthraquinone-based, a benzophenone-based, a diphenyl cyanoacrylate-based, a triazine-based, a p-aminobenzoic acid-based dye, etc., can be used. The organic dye is preferable since, even when it is added as a light absorbent, it does not remain in an insulating film after firing and it is possible to decrease the deterioration in the characteristics of the insulating film caused by a light absorbent. Among them, azo-based and benzophenone-based dyes are preferable.

It is possible to add a polymerization inhibitor to improve thermal stability during storage. As concrete examples of the polymerization inhibitor, hydroquinone, a monoesterified substance of hydroquinone, N-nitrosodiphenyl amine, phenothiazine, p-t-butyl catechol, N-phenyl naphthyl amine, 2,6-di-t-butyl -p-methyl phenol, chloranil, pyrogallol, or the like are mentioned.

In the photosensitive paste, in the case Where a control of solution viscosity is desired, an organic solvent may be added. As the organic solvent to be used at this time, methyl cellosolve, ethyl cellosolve, butyl cellosolve, methyl ethyl ketone, dioxane, acetone, cyclohexanone, cyclopentanone, isobutyl alcohol, isopropyl alcohol, tetrahydrofuran, dimethyl sulfoxide, γ-butyrolactone, bromobenzene, etc., or an organic solvent mixtures containing one kind or, more of them, are used.

The photosensitive paste is prepared, generally, after compounding various components such as an inorganic fine particle, a UV absorber, a photosensitive polymer, a photosensitive monomer, a photopolymerization initiator, a glass frit and a solvent in a predetermined composition, by uniformly mixing and dispersing them by a triple roll mill or a kneader.

Next, a firing is carried out by a firing furnace. Firing atmosphere and temperature are different depending on the kind of paste and substrate, but the firing is carried out in an atmosphere such as in the air, nitrogen or hydrogen. As the firing furnace, it is possible to use a batch-type firing furnace or a belt-type continuous firing furnace.

In the case where a patterning is carried out on a glass substrate, a firing is carried out at a rate of temperature rise of 200 to 400° C./hr and maintaining at a temperature of 540 to 610° C. for 10 to 60 min. The firing temperature is determined depending on a glass powder to be used, but it is preferable to fire at an appropriate temperature at which a shape after the pattern formation is not deformed and the shape of the glass powder does not remain.

If it is lower than the appropriate temperature, void ratio and unevenness of upper portion of the barrier rib increase, and it is not preferable since discharging life is shortened or an erroneous discharge may become easy to occur.

Furthermore, if it is higher than the appropriate temperature, it is not preferable since a shape at the time of pattern formation is deformed and the upper portion of barrier rib becomes round or its height greatly decreases or a predetermined height cannot be obtained.

Furthermore, in the above-mentioned respective steps of coating, exposure, development and firing, for the purpose of drying or preliminary reaction, a heating process of 50 to 300° C. may be introduced.

After coating a phosphor paste by a method of discharging the phosphor paste from a dispenser, a phosphor layer is formed on side and bottom of the barrier rib by drying (e.g., at 180° C. for 15 min) and firing (e.g., at 500° C. for 30 min).

Thus obtained rear panel is laminated with a front panel and sealed, and then a rare gas for discharge such as helium, neon or xenon is enclosed, and a driving circuit was bonded to prepare a plasma display.

EXAMPLES

In the following, we explained in more detail with reference to examples. However, this disclosure is not limited thereto.

By the following procedures, a rear panel of 42 inch (590×964 mm) AC (alternate current) type plasma display panel was formed and an evaluation was conducted. The forming method is explained in turn. The concentration (%) in the examples and comparative examples is wt %. The height of main barrier ribs and the height of the intersection were measured by an ultradeep microscope (produced by Keyence). The pitch and the bottom width of barrier rib were measured by using a microscope (produced by Hyrox) for 20 points, respectively, and their averages were taken.

Example 1

As a glass substrate, PD-200 (produced by Asahi Glass Co.) of 590×964×2.8 mm was used. On this substrate, address electrodes were prepared by using a photosensitive silver paste. From the photosensitive silver paste, through steps of a coating, a drying, an exposure, a development and a firing, address electrodes of a line width 20 μm, a thickness 3 μm and a pitch 100 μm were formed.

Next, a glass paste obtained by kneading 60% of a low-melting-point glass powder containing 75 wt % of bismuth oxide, 10 wt % of a titanium oxide powder of average particle size 0.3 μm, 15% of ethyl cellulose and 15% of terpineol was coated by a screen printing such that bus electrodes of display portion were covered by 20 μm thickness, and then a firing at 570° C. for 15 min was carried out to form a dielectric layer.

On the dielectric layer, a photosensitive glass paste for barrier rib was coated. The photosensitive glass paste for barrier rib was constituted with a glass powder and an organic component containing a photosensitive organic component, and as the glass powder, a glass powder of average particle size 2 μm obtained by grinding a glass consisting of lithium oxide 10 wt %, silicon oxide 25 wt %, boron oxide 30 wt %, zinc oxide 15 wt %, aluminum oxide 5 wt % and calcium oxide 15 wt %, was used. As the organic component containing a photosensitive organic component, an organic component containing 30 wt % of an acryl polymer containing carboxylic group, 30 wt % of trimethylol propane triacrylate, 10 wt % of "Irgacure 369" (produced by Ciba-Geigy Ltd.) which is a photopolymerization initiator and 30 wt % of γ-butyrolactone, was used.

The photosensitive glass paste for barrier rib was prepared by mixing these glass powders and an organic component containing a photosensitive organic component in a weight ratio of 70:30, respectively, and then by kneading by a roll mill.

Next, by using a die coater, this photosensitive paste was coated such that a coating width would be 530 mm, a dried thickness would be 200 μm. The drying was carried out by Clean Oven (produced by Yamato Scientific Co.). After the drying, as a photomask corresponding to a pattern of a precursor of auxiliary barrier rib, a photomask provided with a stripe-like pattern having a pitch of 200 μm, a length of 940 mm, a line width in the display area of 60 μm and a line width in the nondisplay area of 60 μm was prepared, and by using a stepper exposure equipment (produced by Canon Inc.), the positions of the substrate and the photomask were exposed under the conditions of an exposure irradiance of 20 mW/cm$^2$, an exposure time of 20 sec and a distance (gap) between the photomask and the coating film of the substrate of 100 μm.

Then, the photosensitive paste for barrier rib was coated again by using a die coater such that a coating width would be 600 mm and a dried thickness would be 30 μm. The drying was carried out by Clean Oven (produced by Yamato Scientific Co.).

A photomask provided with a stripe-like pattern of a pitch 100 μm, a width 40 μm and a length 536 mm in the display area and a stripe-like pattern of a pitch 120 μm, a width 55 μm and a length 536 mm in the nondisplay area was prepared, and by using a stepper exposure device (produced by Canon Inc.), an exposure operation on the position of the substrate and the photomask was carried out by an exposure irradiance of 20 mW/cm$^2$, an exposure time for 20 sec and a distance (gap) between the photomask and the coating film of the substrate of 100 μm. After the exposure, it was developed in 0.5 wt % aqueous solution of ethanol amine, and further, fired at 580° C. for 15 min, to obtain a barrier rib.

As a result of measurement by a microscope, the bottom width of the auxiliary barrier rib positioned in the display area was 85 μm, and the bottom width L2 positioned in the nondisplay area was 85 μm. The pitch P1 of the main barrier rib positioned in the display area was 100 μm, and the pitch P2 between a main barrier rib and a neighboring main barrier rib positioned at the outermost portion of the nondisplay area was 120 μm. A bottom width L1 of the main barrier rib positioned at the outermost portion of the nondisplay area was 85 μm, and the bottom width L3 of the main barrier rib positioned in the display area was 70 μm. Furthermore, the height of the main barrier rib in the display area was 161 μm, and the height of intersection portion of a main barrier rib and an auxiliary barrier rib positioned at the outermost portion in the nondisplay area was 160 μm. Next, a phosphor paste was coated by a dispenser, and after that, dried (at 180° C. for 15 min) and fired (at 500° C. for 30 min) to form a phosphor layer on side and bottom of the barrier rib. Thus obtained rear, panel was laminated with a front panel and sealed, and then the rare gases of helium and neon were enclosed therein for discharge operation, and a driving circuit was connected to prepare a plasma display. The plasma display was put on and, as a result, of evaluation, no erroneous discharge occurred.

Example 2

Barrier ribs were formed in the same way as Example 1 except preparing, for forming auxiliary barrier ribs, a photomask provided with a pattern which is a stripe-like pattern of a pitch 200 μm and a length 940 mm of which line width in display area is 60 μm and line width of nondisplay area is 60 μm, and using, for forming main barrier ribs, a photomask provided with a stripe-like pattern of a pitch 100 μm, a width 40 μm and a length 536 mm in display area and a photomask provided with a stripe-like pattern of a pitch 300 μm, a width 55 μm and a length 536 mm in nondisplay area. As a result of measurement by a microscope (produced by Hyrox), the bottom width of the auxiliary barrier rib positioned in the display area was 85 μm, and the bottom width L2 positioned in the nondisplay area was 85 μm. The pitch P1 of the main barrier rib positioned in the display area was 100 μm, and the pitch P2 between a main barrier rib and a neighboring main barrier rib positioned at the outermost portion of the nondisplay area was 300 μm. A bottom width L1 of the main barrier rib positioned at the outermost portion of the nondisplay area was 85 μm, and the bottom width L3 of the main barrier rib positioned in the display area was 70 μm. Furthermore, the height of the main barrier rib in the display area was 162 μm, and the height of intersection portion of a main barrier rib and an auxiliary barrier rib positioned at the outermost portion in the nondisplay area was 157 μm. Next, a phosphor paste was coated by a dispenser, and after that, dried (at 180° C. for 15 min) and fired (at 500° C. for 30 min) to form a phosphor layer on side and bottom of the barrier rib. Thus obtained rear panel was laminated with a front panel and sealed, and then the rare gases of helium and neon to be used for discharge were enclosed therein, and a driving circuit was connected to prepare a plasma display. In a panel evaluation, no erroneous discharge occurred.

Example 3

Barrier ribs were formed in the same way as Example 1 except preparing, for forming auxiliary barrier ribs, a photomask provided with a pattern which is a stripe-like pattern of a pitch 200 μm and a length 940 mm of which line width in display area is 60 μm and line width of nondisplay area is 60 μm, and using, for forming main barrier ribs, a photomask provided with a stripe-like pattern of a pitch 100 μm, a width 55 μm and a length 536 mm in display area and a stripe-like pattern of a pitch 300 μm, a width 55 μm and a length 536 mm in nondisplay area. As a result of measurement by a microscope, the bottom width of the auxiliary barrier rib positioned in the display area was 85 μm, and the bottom width L2 positioned in the nondisplay area was 85 μm. The pitch P1 of the main barrier rib positioned in the display area was 100 μm, and the pitch P2 between a main barrier rib and a neighboring main barrier rib positioned at the outermost portion of the nondisplay area was 300 μm. A bottom width L1 of the main barrier rib positioned at the outermost portion of the nondisplay area was 85 μm, and the bottom width L3 of the main barrier rib positioned in the display area was 85 μm. Furthermore, the height of the main barrier rib in the display area was 162 μm, and the height of intersection portion of a main barrier rib and an auxiliary barrier rib positioned at the outermost portion in the nondisplay area was 156 μm. Next, a phosphor paste was coated by a dispenser, and after that, dried (at 180° C. for 15 min) and fired (at 500° C. for 30 min) to form a phosphor layer on side and bottom of the barrier rib. Thus obtained rear panel was laminated with a front panel and sealed, and then rare gases of helium and neon which are gases for discharge were enclosed therein, and a driving circuit was connected to prepare a plasma display. In a panel evaluation, no erroneous discharge occurred.

Example 4

A rear panel member was formed in the same way as Example 1 except preparing, for forming auxiliary barrier ribs, a photomask provided with a pattern which is a stripe-like pattern of a pitch 200 μm and a length 940 mm of which line width in display area is 60 μm and line width of nondisplay area is 60 μm, and using, for forming main barrier ribs, a photomask provided with a stripe-like pattern of a pitch 100

μm, a width 40 μm and a length 536 mm in display area and a stripe-like pattern of a pitch 300 μm, a width 180 μm and a length 536 mm in nondisplay area. As a result of measurement by a microscope, the bottom width of the auxiliary barrier rib positioned in the display area was 85 μm, and the bottom width L2 positioned in the nondisplay area was 85 μm. The pitch P1 of the main barrier rib positioned in the display area was 100 μm, and the pitch P2 between a main barrier rib and a neighboring main barrier rib positioned at the outermost portion of the nondisplay area was 300 μm. A bottom width L1 of the main barrier rib positioned at the outermost portion of the nondisplay area was 210 μm, and the bottom width L3 of the main barrier rib positioned in the display area was 70 μm. Furthermore, the height of the main barrier rib in the display area was 162 μm, and the height of intersection portion of a main barrier rib and an auxiliary barrier rib positioned at the outermost portion in the nondisplay area was 156 μm. Next, a phosphor paste was coated by a dispenser, and after that, dried (at 180° C. for 15 min) and fired (at 500° C. for 30 min) to form a phosphor layer on side and bottom of the barrier rib. Thus obtained rear panel was laminated with a front panel and sealed, and then rare gases of helium and neon which are gases for discharge were enclosed therein, and a driving circuit was connected to prepare a plasma display. In a panel evaluation, no erroneous discharge occurred.

Example 5

Barrier ribs were formed in the same way as Example 1 except preparing, for forming auxiliary barrier ribs, a photomask provided with a pattern which is a stripe-like pattern of a pitch 200 μm and a length 940 mm of which line width in display area is 60 μm and line width of nondisplay area is 60 μm, and using, for forming main barrier ribs, a photomask provided with a stripe-like pattern of a pitch 100 μm, a width 25 μm and a length 536 mm in display area and a stripe-like pattern of a pitch 200 μm, a width 110 μm and a length 536 mm in nondisplay area. As a result of measurement by a microscope, the bottom width of the auxiliary barrier rib positioned in the display area was 85 μm, and the bottom width L2 positioned in the nondisplay area was 85 μm. The pitch P1 of the main barrier rib positioned in the display area was 100 μm, and the pitch P2 between a main barrier rib and a neighboring main barrier rib positioned at the outermost portion of the nondisplay area was 200 μm. A bottom width. L1 of the main barrier rib positioned at the outermost portion of the nondisplay area was 140 μm, and the bottom width L3 of the main barrier rib positioned in the display area was 55 μm. Furthermore, the height of the main barrier rib in the display area was 162 μm, and the height of intersection portion of a main barrier rib and an auxiliary barrier rib at the outermost portion of the nondisplay area was 156 μm. Next, a phosphor paste was coated by a dispenser to form a phosphor layer, and after that, dried (at 180° C. for 15 min) and fired (at 500° C. for 30 min) to form a phosphor layer on side and bottom of the barrier rib. Thus obtained rear panel was laminated with a front panel and sealed, and then rare gases of helium and neon which are gases for discharge were enclosed therein, and a driving circuit was connected to prepare a plasma display. In a panel evaluation, no erroneous discharge occurred.

Example 6

Barrier ribs were formed in the same way as Example 1 except preparing, for forming auxiliary barrier ribs, a photomask provided with a pattern which is a stripe-like pattern of a pitch 420 μm and a length 940 mm of which line width in display area is 60 μm and line width of nondisplay area is 35 μm, and using, for forming main barrier ribs, a photomask provided with a stripe-like pattern of a pitch 140 μm, a width 40 μm and a length 536 mm in display area and a stripe-like pattern of a pitch 140 μm, a width 40 μm and a length 536 mm in nondisplay area. As a result of measurement by a microscope, the bottom width of the auxiliary barrier rib positioned in the display area was 85 μm, and the bottom width L2 positioned in the nondisplay area was 50 μm. The pitch P1 of the main barrier rib positioned in the display area was 140 μm, and the pitch P2 between a main barrier rib and a neighboring main barrier rib positioned at the outermost portion of the nondisplay area was 140 μm. A bottom width L1 of the main barrier rib positioned at the outermost portion of the nondisplay area was 70 μm, and the bottom width L3 of the main barrier rib positioned in the display area was 70 μm. Furthermore, the height of the main barrier rib in the display area was 163 μm, and the height of intersection portion of a main barrier rib and an auxiliary barrier rib at the outermost portion in the nondisplay area was 160 μm. Next, a phosphor paste was coated by a dispenser to form a phosphor layer, and after that, dried (at 180° C. for 15 min) and fired (at 500° C. for 30 min) to form a phosphor layer on side and bottom of the barrier rib. Thus obtained rear panel was laminated with a front panel and sealed, and then rare gases of helium and neon which are gases for discharge were enclosed therein, and a driving circuit was connected to prepare a plasma display. In a panel evaluation, no erroneous discharge occurred.

Example 7

Barrier ribs were formed in the same way as Example 1 except preparing, for forming auxiliary barrier ribs, a photomask provided with a pattern which is a stripe-like pattern of a pitch 420 μm and a length 940 mm of which line width in display area is 60 μm and line width of nondisplay area is 35 μm, and using, for forming main barrier ribs, a photomask provided with a stripe-like pattern of a pitch 140 μm, a width 40 μm and a length 536 mm in display area and a stripe-like pattern of a pitch 140 μm, a width 60 μm and a length 536 mm in nondisplay area. As a result of measurement by a microscope, the bottom width of the auxiliary barrier rib positioned in the display area was 85 μm, and the bottom width L2 positioned in the nondisplay area was 50 μm. The pitch P1 of the main barrier rib positioned in the display area was 140 μm, and the pitch P2 between a main barrier rib and a neighboring main barrier rib positioned at the outermost portion of the nondisplay area was 140 μm. A bottom width L1 of the main barrier rib positioned at the outermost portion of the nondisplay area was 90 μm, and the bottom width L3 of the main barrier rib positioned in the display area was 70 μm. Furthermore, the height of the main barrier rib in the display area was 163 μm, and the height of intersection portion of a main barrier rib and an auxiliary barrier rib at the outermost portion in the nondisplay area was 158 μm. Next, a phosphor paste was coated by a dispenser to form a phosphor layer, and after that, dried (at 180° C. for 15 min) and fired (at 500° C. for 30 min) to form a phosphor layer on side and bottom of the barrier rib. Thus obtained rear panel was laminated with a front panel and sealed, and then rare gases of helium and neon which are gases for discharge were enclosed therein, and a driving circuit was connected to prepare a plasma display. In a panel evaluation, no erroneous discharge occurred.

Example 8

Barrier ribs were formed in the same way as Example 1 except preparing, for forming auxiliary barrier ribs, a photomask provided with a pattern which is a stripe-like pattern of a pitch 420 μm and a length 940 mm of which line width in display area is 60 μm and line width of nondisplay area is 60 μm, and using, for forming main barrier ribs, a photomask provided with a stripe-like pattern of a pitch 140 μm, a width 40 μm and a length 536 mm in display area and a stripe-like pattern of a pitch 300 μm, a width 80 μm and a length 536 mm in nondisplay area. As a result of measurement by a microscope, the bottom width of the auxiliary barrier rib positioned in the display area was 85 μm, and the bottom width L2 positioned in the nondisplay area was 85 μm. The pitch P1 of the main barrier rib positioned in the display area was 140 μm, and the pitch P2 between a main barrier rib and a neighboring main barrier rib positioned at the outermost portion of the nondisplay area was 300 μm. A bottom width L1 of the main barrier rib positioned at the outermost portion of the nondisplay area was 110 μm, and the bottom width L3 of the main barrier rib positioned in the display area was 70 μm. Furthermore, the height of the main barrier rib in the display area was 163 μm, and the height of intersection portion of a main barrier rib and an auxiliary barrier rib at the outermost portion in the nondisplay area was 158 μm. Next, a phosphor paste was coated by a dispenser to form a phosphor layer, and after that, dried (at 180° C. for 15 min) and fired (at 500° C. for 30 min) to form a phosphor layer on side and bottom of the barrier rib. Thus obtained rear panel was laminated with a front panel and sealed, and then rare gases of helium and neon which are gases for discharge were enclosed therein, and a driving circuit was connected to prepare a plasma display. In a panel evaluation, no erroneous discharge occurred.

Comparative Example 1

Barrier ribs were formed in the same way as Example 1 except preparing, for forming auxiliary barrier ribs, a photomask provided with a pattern which is a stripe-like pattern of a pitch 200 μm and a length 940 mm of which line width in display area is 60 μm and line width of nondisplay area is 60 μm, and using, for forming main barrier ribs, a photomask provided with a stripe-like pattern of a pitch 100 μm, a width 25 μm and a length 536 mm in display area and a stripe-like pattern of a pitch 100 μm, a width 25 μm and a length 536 mm in nondisplay area. As a result of measurement by a microscope, the bottom width of the auxiliary barrier rib positioned in the display area was 85 μm, and the bottom width L2 positioned in the nondisplay area was 85 μm. The pitch P1 of the main barrier rib positioned in the display area was 100 μm, and the pitch P2 between a main barrier rib and a neighboring main barrier rib positioned at the outermost portion of the nondisplay area was 100 μm. A bottom width L1 of the main barrier rib positioned at the outermost portion of the nondisplay area was 55 μm, and the bottom width L3 of the main barrier rib positioned in the display area was 55 μm. Furthermore, the height of the main barrier rib in the display area was 162 μm, and the height of intersection portion of a main barrier rib and an auxiliary barrier rib positioned at the outermost portion in the nondisplay area was 170 μm. Next, a phosphor paste was coated by a dispenser to form a phosphor layer, and after that, dried (at 180° C. for 15 min) and fired (at 500° C. for 30 min) to form a phosphor layer on side and bottom of the barrier rib. Thus obtained rear panel was laminated with a front panel and sealed, and then rare gases of helium and neon which are gases for discharge were enclosed therein, and a driving circuit was connected to prepare a plasma display. As a result of a panel evaluation, erroneous discharges occurred at right and left edges of the display area.

Comparative Example 2

Barrier ribs were formed in the same way as Example 1 except preparing, for forming auxiliary barrier ribs, a photomask provided with a pattern which is a stripe-like pattern of a pitch 200 μm and a length 940 mm of which line width in display area is 60 μm and line width of nondisplay area is 60 μm, and using, for forming main barrier ribs, a photomask provided with a stripe-like pattern of a pitch 100 μm, a width 40 μm and a length 536 mm in display area and a stripe-like pattern of a pitch 340 μm, a width 40 μm and a length 536 mm in nondisplay area. As a result of measurement by a microscope, the bottom width of the auxiliary barrier rib positioned in the display area was 85 μm, and the bottom width L2 positioned in the nondisplay area was 85 μm. The pitch P1 of the main barrier rib positioned in the display area was 100 μm, and the pitch P2 between a main barrier rib and a neighboring main barrier rib positioned at the outermost portion of the nondisplay area was 340 μm. A bottom width L1 of the main barrier rib positioned at the outermost portion of the nondisplay area was 75 μm, and the bottom width L3 of the main barrier rib positioned in the display area was 75 μm. Furthermore, the height of the main barrier rib in the display area was 162 μm, and the height of intersection portion of a main barrier rib and an auxiliary barrier rib positioned at the outermost portion in the nondisplay area was 172 μm. Next, a phosphor paste was coated by a dispenser to form a phosphor layer, and after that, dried (at 180° C. for 15 min) and fired (at 500° C. for 30 min) to form a phosphor layer on side and bottom of the barrier rib. Thus obtained rear panel was laminated with a front panel and sealed, and then rare gases of helium and neon which are gases for discharge were enclosed therein, and a driving circuit was connected to prepare a plasma display. As a result of a panel evaluation, erroneous discharges occurred at right and left edges of the display area.

Comparative Example 3

Barrier ribs were formed in the same way as Example 1 except preparing, for forming auxiliary barrier ribs, a photomask provided with a pattern which is a stripe-like pattern of a pitch 420 μm and a length 940 mm of which line width in display area is 60 μm and line width of nondisplay area is 90 μm, and using, for forming main barrier ribs, a photomask provided with a stripe-like pattern of a pitch 140 μm, a width 40 μm and a length 536 mm in display area and a stripe-like pattern of a pitch 300 μm, a width 40 μm and a length 536 mm in nondisplay area. As a result of measurement by a microscope, the bottom width of the auxiliary barrier rib positioned in the display area was 85 μm, and the bottom width L2 positioned in the nondisplay area was 115 μm. The pitch P1 of the main barrier rib positioned in the display area was 100 μm, and the pitch P2 between a main barrier rib and a neighboring main barrier rib positioned at the outermost portion of the nondisplay area was 300 μm. A bottom width L1 of the main barrier rib positioned at the outermost portion of the nondisplay area was 70 μm, and the bottom width L3 of the main barrier rib positioned in the display area was 70 μm. Furthermore, the height of the main barrier rib in the display area was 162 μm, and the height of intersection portion of a main barrier rib and an auxiliary barrier rib positioned at the outermost portion in the nondisplay area was 176 μm. Next, a phosphor paste was coated by a dispenser to form a phosphor layer, and after that, dried (at 180° C. for 15 min) and fired (at 500° C. for 30 min) to form a phosphor layer on side and bottom of the barrier rib. Thus obtained rear panel was laminated with a front panel and sealed, and then rare gases of helium and neon which are gases for discharge were enclosed therein, and a driving circuit was connected to prepare a plasma display. As a result of a panel evaluation, erroneous discharges occurred at right and left edges of the display area.

TABLE 1

| | The pattern of the photomask corresponding to a pattern of a precursor of main barrier rib | | | | | The pattern of the photomask corresponding to a pattern of a precursor of auxiliary barrier rib | | | | |
|---|---|---|---|---|---|---|---|---|---|---|
| | In the display area | | In the nondisplay area | | | In the display area | | In the nondisplay area | | |
| | Pitch | Width | Pitch | Width | Length | Pitch | Width | Pitch | Width | Length |
| The photomask used for example 1 | 100 mm | 40 mm | 120 mm | 55 mm | 536 mm | 200 mm | 60 mm | 200 mm | 60 mm | 940 mm |
| The photomask used for example 2 | 100 mm | 40 mm | 300 mm | 55 mm | 536 mm | 200 mm | 60 mm | 200 mm | 60 mm | 940 mm |
| The photomask used for example 3 | 100 mm | 55 mm | 300 mm | 55 mm | 536 mm | 200 mm | 60 mm | 200 mm | 60 mm | 940 mm |
| The photomask used for example 4 | 100 mm | 40 mm | 300 mm | 180 mm | 536 mm | 200 mm | 60 mm | 200 mm | 60 mm | 940 mm |
| The photomask used for example 5 | 100 mm | 25 mm | 200 mm | 110 mm | 536 mm | 200 mm | 60 mm | 200 mm | 60 mm | 940 mm |
| The photomask used for example 6 | 140 mm | 40 mm | 140 mm | 40 mm | 536 mm | 420 mm | 60 mm | 420 mm | 35 mm | 940 mm |
| The photomask used for example 7 | 140 mm | 40 mm | 140 mm | 60 mm | 536 mm | 420 mm | 60 mm | 420 mm | 35 mm | 940 mm |
| The photomask used for example 8 | 140 mm | 40 mm | 300 mm | 80 mm | 536 mm | 420 mm | 60 mm | 420 mm | 60 mm | 940 mm |
| The photomask used for comparative example 1 | 100 mm | 25 mm | 100 mm | 25 mm | 536 mm | 200 mm | 60 mm | 200 mm | 60 mm | 940 mm |
| The photomask used for comparative example 2 | 100 mm | 40 mm | 340 mm | 40 mm | 536 mm | 200 mm | 60 mm | 200 mm | 60 mm | 940 mm |
| The photomask used for comparative example 3 | 140 mm | 40 mm | 300 mm | 40 mm | 536 mm | 420 mm | 60 mm | 420 mm | 90 mm | 940 mm |

TABLE 2

| | Bottom width of barrier rib (μm) | | | | | Pitch between main barrier ribs (μm) | | | Height of the main barrier rib in the display area | Height of intersection portion of a main barrier rib and an auxiliary barrier rib positioned at the outermost portion in the nondisplay | Erroneous |
|---|---|---|---|---|---|---|---|---|---|---|---|
| | L1 | L2 | L3 | L2/L1 | L1/L3 | P1 | P2 | P2/P1 | (μm) | area (μm) | discharge |
| Example 1 | 85 | 85 | 70 | 1.0 | 1.2 | 100 | 120 | 1.2 | 161 | 160 | No |
| Example 2 | 85 | 85 | 70 | 1.0 | 1.2 | 100 | 300 | 3.0 | 162 | 157 | No |
| Example 3 | 85 | 85 | 85 | 1.0 | 1.0 | 100 | 300 | 3.0 | 162 | 156 | No |
| Example 4 | 210 | 85 | 70 | 0.4 | 3.0 | 100 | 300 | 3.0 | 162 | 156 | No |
| Example 5 | 140 | 85 | 55 | 0.6 | 2.5 | 100 | 200 | 2.0 | 162 | 156 | No |
| Example 6 | 70 | 50 | 70 | 0.7 | 1.0 | 140 | 140 | 1.0 | 163 | 160 | No |
| Example 7 | 90 | 50 | 70 | 0.6 | 1.3 | 140 | 140 | 1.0 | 163 | 158 | No |
| Example 8 | 110 | 85 | 70 | 0.8 | 1.6 | 140 | 300 | 2.1 | 163 | 158 | No |
| Comparative example 1 | 55 | 85 | 55 | 1.5 | 1.0 | 100 | 100 | 1.0 | 162 | 170 | Occurred |
| Comparative example 2 | 70 | 85 | 70 | 1.2 | 1.0 | 100 | 340 | 3.4 | 162 | 172 | Occurred |
| Comparative example 3 | 70 | 115 | 70 | 1.6 | 1.0 | 140 | 300 | 2.1 | 162 | 176 | Occurred |

The references in Table 2 denote the following:

P1: pitch between main barrier ribs positioned in display area

P2: pitch between a main barrier rib positioned at the outermost portion in non-display area and a neighboring main barrier rib L1: bottom width of main barrier rib positioned at the outermost portion in non-display area L2: bottom width of auxiliary barrier rib positioned at the outermost portion in nondisplay area L3: bottom width of main barrier rib positioned at the outermost portion in display area

The invention claimed is:

1. A method of producing a rear panel for plasma display comprising, on a substrate, approximately stripe-like address electrodes, a dielectric layer covering said address electrode, and a lattice-like barrier rib positioned on said dielectric layer and consisting of main barrier ribs which are nearly parallel to said address electrodes and auxiliary barrier ribs intersecting said main barrier ribs, wherein a bottom width of an auxiliary barrier rib intersecting a main barrier rib positioned at an outermost portion in a nondisplay area to the right and left of the display area, is 0.3 to 1.0 times a bottom width of said main barrier rib positioned at the outermost portion in the nondisplay areas on the right and left of the display area, the method comprising applying a photosensitive glass paste consisting of an inorganic component mainly comprising glass powder and an organic component containing a photosensitive organic substance over a substrate provided with either address electrodes or precursors thereof and either a dielectric layer or a precursor thereof, followed by exposing using a photomask designed for forming precursors of auxiliary barrier rib, further coating with the photosensitive glass paste, exposing using a photomask designed for forming precursors of main barrier rib, and developing to form a precursor of barrier rib consisting of precursors of main barrier rib and precursors of auxiliary barrier rib, which is then fired to form barrier ribs, wherein the bottom width of the precursor of auxiliary barrier rib intersecting the precursor of main barrier rib positioned at the outermost portion in the nondisplay areas on the right and the left of the display area is 0.3 to 1.0 times the bottom width of said precursor of main barrier rib positioned at the outermost portion in the nondisplay areas on the right and the left of the display area.

2. A method of producing a rear panel for plasma display comprising, on a substrate, approximately stripe-like address electrodes, a dielectric layer covering said address electrode, and a lattice-like barrier rib positioned on said dielectric layer and consisting of main barrier ribs which are nearly parallel to said address electrodes and auxiliary barrier ribs intersecting said main barrier ribs, wherein a bottom width of an auxiliary barrier rib intersecting a main barrier rib positioned at an outermost portion in a nondisplay area to the right and left of the display area, is 0.3 to 1.0 times a bottom width of said main barrier rib positioned at the outermost portion in the nondisplay areas on the right and left of the display area, and wherein the bottom width of the main barrier rib positioned at the outermost portion in the nondisplay area on the right and the left of the display area is 1.2 to 3.0 times the bottom width of the main barrier ribs positioned in the display area, the method comprising applying a photosensitive glass paste consisting of an inorganic component mainly comprising glass powder and an organic component containing a photosensitive organic substance over a substrate provided with either address electrodes or precursors thereof and either a dielectric layer or a precursor thereof, followed by exposing using a photomask designed for forming precursors of auxiliary barrier rib, further coating with the photosensitive glass paste, exposing using a photomask designed for forming precursors of main barrier rib, and developing to form a precursor of barrier rib consisting of precursors of main barrier rib and precursors of auxiliary barrier rib, which is then fired to form barrier ribs, wherein the bottom width of the precursor of auxiliary barrier rib intersecting the precursor of main barrier rib positioned at the outermost portion in the nondisplay areas on the right and the left of the display area is 0.3 to 1.0 times the bottom width of said precursor of main barrier rib positioned at the outermost portion in the nondisplay areas on the right and the left of the display area, and wherein the bottom width of the precursor of main barrier rib positioned at the outermost portion in the nondisplay areas on the right and the left of the display area is 1.2 to 3.0 times the bottom width of the precursors of main barrier rib positioned in the display area.

3. A method of producing a rear panel for plasma display comprising, on a substrate, approximately stripe-like address electrodes, a dielectric layer covering said address electrode, and a lattice-like barrier rib positioned on said dielectric layer and consisting of main barrier ribs which are nearly parallel to said address electrodes and auxiliary barrier ribs intersecting said main barrier ribs, wherein a bottom width of an auxiliary barrier rib intersecting a main barrier rib positioned at an outermost portion in a nondisplay area to the right and left of the display area, is 0.3 to 1.0 times a bottom width of said main barrier rib positioned at the outermost portion in the nondisplay areas on the right and left of the display area, and wherein the pitch between said main barrier rib positioned at the outermost portion in the nondisplay area on the right and the left of the display area and a neighboring main barrier rib is 1.2 to 3.0 times the pitch between the main barrier ribs positioned in the display area, and the method comprising applying a photosensitive glass paste consisting of an inorganic component mainly comprising glass powder and an organic component containing a photosensitive organic substance over a substrate provided with either address electrodes or precursors thereof and either a dielectric layer or a precursor thereof, followed by exposing using a photomask designed for forming precursors of auxiliary barrier rib, further coating with the photosensitive glass paste, exposing using a photomask designed for forming precursors of main barrier rib, and developing to form a precursor of barrier rib consisting of precursors of main barrier rib and precursors of auxiliary barrier rib, which is then fired to form barrier ribs, wherein the bottom width of the precursor of auxiliary barrier rib intersecting the precursor of main barrier rib positioned at the outermost portion in the nondisplay areas on the right and the left of the display area is 0.3 to 1.0 times the bottom width of said precursor of main barrier rib positioned at the outermost portion in the nondisplay areas on the right and the left of the display area, and wherein the pitch between the precursor of main barrier rib positioned at the outermost portion in the nondisplay areas on the right and the left of the display area and the neighboring precursor of main barrier rib is 1.2 to 3.0 times the pitch between the precursors of main barrier rib positioned in the display area.

4. A method of producing a rear panel for plasma display comprising, on a substrate, approximately stripe-like address electrodes, a dielectric layer covering said address electrode, and a lattice-like barrier rib positioned on said dielectric layer and consisting of main barrier ribs which are nearlyparallel to said address electrodes and auxiliary barrier ribs intersecting said main barrier ribs, wherein a bottom width of an auxiliary barrier rib intersecting a main barrier rib positioned at an outermost portion in a nondisplay area to the right and left of the display area, is 0.3 to 1.0 times a bottom width of said main barrier rib positioned at the outermost portion in the nondisplay areas on the right and left of the display area, wherein the bottom width of the main barrier rib positioned at the outermost portion in the nondisplay area on the right and the left of the display area is 1.2 to 3.0 times the bottom width of the main barrier ribs positioned in the display area, and wherein the pitch between said main barrier rib positioned at the outermost portion in the nondisplay area on the right and the left of the display area and a neighboring main barrier rib is 1.2 to 3.0 times the pitch between the main barrier ribs positioned in the display area, and the method comprising applying a photosensitive glass paste consisting of an inorganic component mainly comprising glass powder and an organic component containing a photosensitive organic substance over a substrate provided with either address electrodes or precursors thereof and either a dielectric layer or a precursor thereof, followed by exposing using a photomask designed for forming precursors of auxiliary barrier rib, further coating with the photosensitive glass paste, exposing using a photomask designed for forming precursors of main barrier rib, and developing to form a precursor of barrier rib consisting of precursors of main barrier rib and precursors of auxiliary barrier rib, which is then fired to form barrier ribs, wherein the bottom width of the precursor of auxiliary barrier rib intersecting the precursor of main barrier rib positioned at the outermost portion in the nondisplay area on the right and the left of the display area is 0.3 to 1.0 times the bottom width of said precursor of main barrier rib positioned at the outermost portion in the nondisplay areas on the right and the left of the display area, wherein the bottom width of the precursor of main barrier rib positioned at the outermost portion in the nondisplay areas on the right and the left of the display area is 1.2 to 3.0 times the bottom width of the precursors of main barrier rib positioned in the display area, and wherein the pitch between the precursor of main barrier rib positioned at the outermost portion in the nondisplay areas on the right and the left of the display area and the neighboring precursor of main barrier rib is 1.2 to 3.0 times the pitch between the precursors of main barrier rib positioned in the display area.

* * * * *